US009604467B2

(12) United States Patent
Ihara

(10) Patent No.: US 9,604,467 B2
(45) Date of Patent: Mar. 28, 2017

(54) PRINTING APPARATUS WITH CONTROLLABLE BACK TENSION ON INK FILM AND TRANSFER FILM

(71) Applicant: JVC KENWOOD Corporation, Yokohama-shi, Kanagawa (JP)

(72) Inventor: Keiji Ihara, Yokohama (JP)

(73) Assignee: JVC KENWOOD CORPORATION, Yokohama-Shi, Kanagawa (JP)

( * ) Notice: Subject to any disclaimer, the term of this patent is extended or adjusted under 35 U.S.C. 154(b) by 10 days.

(21) Appl. No.: 14/988,089

(22) Filed: Jan. 5, 2016

(65) Prior Publication Data

US 2016/0236481 A1 Aug. 18, 2016

(30) Foreign Application Priority Data

Feb. 13, 2015 (JP) ..... 2015-026391

(51) Int. Cl.
*B41J 2/325* (2006.01)

(52) U.S. Cl.
CPC ..... *B41J 2/325* (2013.01)

(58) Field of Classification Search
CPC ..... B41J 2/325
See application file for complete search history.

(56) References Cited

U.S. PATENT DOCUMENTS 6,587,135 B1 * 7/2003 Suzuki ..... B41J 2/325 347/171
2011/0180648 A1 * 7/2011 Onozato ..... B41J 2/0057 242/412

FOREIGN PATENT DOCUMENTS

JP 4337582 B2 7/2009

* cited by examiner

*Primary Examiner* — Alessandro Amari
*Assistant Examiner* — Roger W Pisha, II
(74) *Attorney, Agent, or Firm* — Nath, Goldberg & Meyer; Jerald L. Meyer; Leonid D. Thenor

(57) ABSTRACT

A printing apparatus capable of realizing a high quality printing at low cost is provided. In the printing apparatus, an ink film is wound around and stretched between a first bobbin and a second bobbin, while a transfer film is wound around and stretched between a third bobbin and a fourth bobbin, and the printing apparatus has a platen roller and a thermal head configured to put the ink film and the transfer film into pressed contact, in the transfer operation, and a driving unit configured to move the ink film between the first bobbin and the second bobbin. The driving unit has a motor, a first transmission route portion configured to constantly transmit a torque to the first bobbin, and a second transmission route portion, branching from the first transmission route portion, configured to selectively transmit the torque to the second bobbin.

8 Claims, 11 Drawing Sheets

PRINTING APPARATUS WITH CONTROLLABLE BACK TENSION ON INK FILM AND TRANSFER FILM

CROSS-REFERENCE TO RELATED APPLICATIONS

This application claims benefit of priority to Japanese Patent Application No. 2015-026391 filed on Feb. 13, 2015, the entire contents of which are incorporated by reference herein.

FIELD OF THE INVENTION

The present invention relates to a printing apparatus, and in particular, a printing apparatus for carrying out a transfer printing while moving an ink film and a film to be transferred for transfer printing ink of the ink film between a supply bobbin and a winding bobbin around which they are wound respectively.

BACKGROUND OF THE INVENTION

There is a known printing apparatus for carrying out a printing while moving a ribbon shaped ink film and a ribbon shaped film to be transferred for transfer printing ink of the ink film between a supply bobbin and a winding bobbin around which they are wound respectively, and one example of such a printing apparatus is disclosed in Japanese Patent No. 4,337,582.

In the printing apparatus as disclosed in Japanese Patent No. 4,337,582, an ink film on which ink layers of four colors are repeatedly applied in a ribbon direction and a film to be transferred (referred to as an intermediate recording medium in Japanese Patent No. 4,337,582) are moved while being in pressed contact. This pressed contact moving is repeatedly carried out with respect to an identical transfer region (transfer frame) of the film to be transferred, for each one of the ink layers of four colors. In each moving, the ink has a temperature raised by a thermal head, and the ink is transferred by sublimation or melting to the transfer frame in a pattern according to an image to be printed. In this way, a desired color image is formed on the film to be transferred.

More specifically, the color image is formed by superposed transfers of the ink of respective colors to an identical transfer frame one color by one color as the thermal head is put in pressed contact with a face on opposite side of the ink layer, while moving the ink film in a ribbon direction with its ink layer overlapping with the film to be transferred.

Namely, each time the transfer of each color is to be carried out, operations of separating the thermal head, winding and cueing one transfer frame part of the film to be transferred, cueing a next color of the ink film, and putting the thermal head into pressed contact are carried out.

Consequently, in order to form the color image using the ink of four colors, a cueing operation is carried out four times (a winding operation is carried out three times), for the film to be transferred.

In this printing apparatus, the ink film and the film to be transferred are wound around and stretched between a pair of bobbins comprising a supply bobbin and a winding bobbin that are attached to the printing apparatus in correspondence to respective films.

Then, by driving a total of four motors provided in correspondence to respective bobbins, the ink film and the film to be transferred are made to move in a feeding out and winding direction between respective pairs of bobbins.

Also, the printing apparatus as disclosed in Japanese Patent No. 4,337,582 has a re-transfer unit for transferring again the image that has been transfer printed on the film to be transferred to an object to be re-transferred (a card in this example).

For the printing apparatus, there is a demand from the market that it should be capable of realizing a high quality printing at low cost.

The printing apparatus as disclosed in Japanese Patent No. 4,337,582 has four motors, so that the dynamic characteristics in the movement of the ink film and the film to be transferred (also referred to as the transfer film) between bobbins are prone to be unbalanced, in the case where the initial fluctuations of the dynamic characteristics of respective motors are large, or in the case where the levels of change in time of the dynamic characteristics are largely different from each other.

When the dynamic characteristics are unbalanced, in the movement of the ink film and the film to be transferred (or the transfer film) between bobbins, tensions generated according to rotational torques of the supply bobbin and the winding bobbin are becoming insufficient so that there is a concern for the occurrence of troubles, such as slacking of the films occurs, a positioning in high precision cannot be made, the films are stuck together by electrostatic force, etc.

For these reasons, the printing apparatus as disclosed in Japanese Patent No. 4,337,582 requires to select motors of the relatively high cost in which the initial dynamic characteristics and their change in time characteristics are equalized.

Moreover, there has been a need to implement a control unit of high control performance that can independently control the driving of four motors simultaneously in high precision.

For this reason, it has not been easy to make the high quality printing and the low cost compatible, and there has been a room for the improvement.

SUMMARY OF THE INVENTION

It is therefore an object of the present invention to provide a printing apparatus capable of realizing a high quality printing at low cost.

In order to solve the above noted problem, the present invention provides a printing apparatus for printing images on a transfer film by a transfer operation to transfer ink of an ink film onto the transfer film, comprising: four bobbins, wherein one film among the ink film and the transfer film is wound around and stretched between a first bobbin and a second bobbin, while another film among the ink film and the transfer film is wound around and stretched between a third bobbin and a fourth bobbin; a platen roller and a thermal head configured to put the ink film and the transfer film into pressed contact, in the transfer operation; and a driving unit configured to move said one film between the first bobbin and the second bobbin, the driving unit having: a motor; a first transmission route portion configured to constantly transmit a torque generated by the motor to the first bobbin in a rotational direction according to a rotational direction of the motor; and a second transmission route portion, branching from the first transmission route portion at a branching portion, configured to selectively transmit the torque to the second bobbin, the second transmission router portion being configured to not transmit the torque to the second bobbin when the motor is rotating in a first rotational direction, and transmit the torque to the second bobbin when the motor is rotating in a second rotational direction opposite of the first rotational direction.

In the printing apparatus described above, the motor may be rotating in the first rotational direction in the transfer operation, and the motor may be rotating in the second rotational direction in a cueing movement of the ink film and the transfer film that is necessary before performing the transfer operation.

In the printing apparatus described above, the second transmission route portion may have a one-way clutch, and the second transmission route portion is configured to selectively carry out a non-transmission and a transmission of the torque by an operation of the one-way clutch.

In the printing apparatus described above, the branching portion may be configured to have a driving gear included in the first transmission route portion, and a driven gear included in the second transmission route portion, the driven gear being engaged with the driving gear and having a less number of teeth than a number of teeth in the driving gear.

In the printing apparatus described above, the second transmission route portion may have a torque limiter for regulating an upper limit of the torque to be transmitted to the second bobbin, when the motor is rotating in the second rotational direction.

In the printing apparatus described above, the driving unit may move the transfer film, and the printing apparatus may further comprise a re-transfer unit for carrying out a re-transfer operation to re-transfer the images that have been printed on the transfer film to an object to be re-transferred.

According to the present invention, it is possible to provide a printing apparatus capable of realizing a high quality printing at low cost.

DETAILED DESCRIPTION OF THE INVENTION

A printing apparatus 51 that is an example of the printing apparatus according to one embodiment of the present invention will be described with references to FIG. 1 to FIG. 12.

The printing apparatus 51 is a printing apparatus of a re-transfer scheme, which is the so-called card printer in this example.

Figure 1:
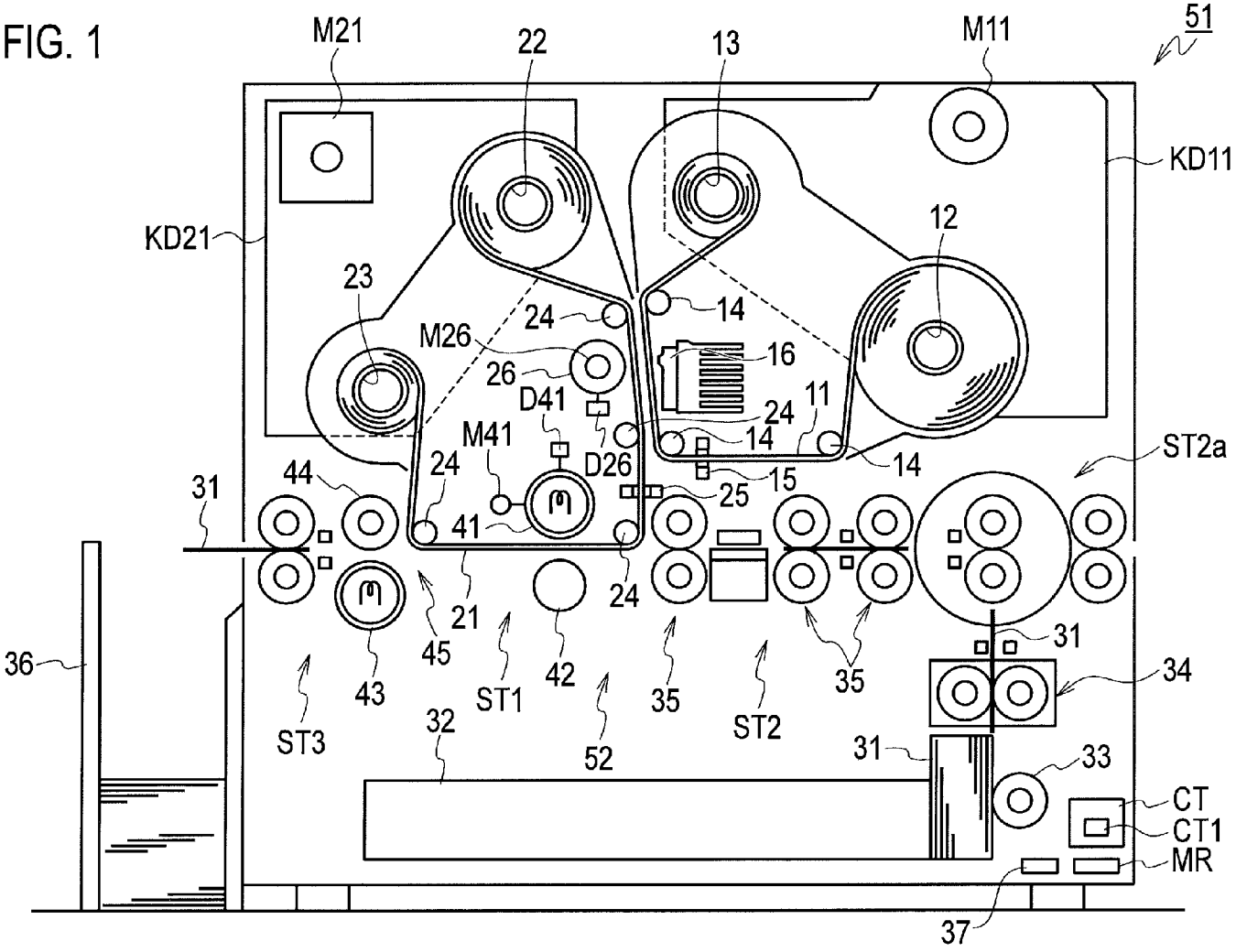
FIG. 1 is an overall configuration diagram for explaining a printing apparatus 51 according to one embodiment of the present invention.

In FIG. 1 which shows an entire configuration, the printing apparatus 51 is made to be freely detachably attachable with a supply bobbin 12 and a winding bobbin 13 for an ink film 11.

The supply bobbin 12 and the winding bobbin 13 that have been attached are driven into rotation by an ink film driving unit KD11 having a motor M11 as a driving source. A rotational speed and a rotational direction of the motor M11 are controlled by a control unit CT that is provided on the printing apparatus 51.

The motor M11 is a DC motor with a deceleration mechanism, for example.

Details of the ink film driving unit KD11 will be described later.

The ink film 11 is wound around and stretched between the supply bobbin 12 and the winding bobbin 13, and bridged over a prescribed running route as being guided by a plurality of guide shafts 14.

An ink film sensor 15 for cueing is arranged on a course of the running route of the ink film 11.

The ink film sensor 15 detects a cueing mark 11*d* of the ink film 11 (see FIG. 3), and sends out an ink film mark detection information J1 (see FIG. 2) toward the control unit CT.

A thermal head 16 is arranged between the ink film sensor 15 and the winding bobbin 13 in the running route of the ink film 11.

The printing apparatus 51 is made to be freely detachably attachable with a supply bobbin 22 and a winding bobbin 23 for a film to be transferred 21 (hereafter referred to as a transfer film 21), on left side of FIG. 1 with respect to the installed ink film 11.

The supply bobbin 22 and the winding bobbin 23 that have been attached are driven into rotation by a transfer film driving unit KD21 having a motor M21 as a driving source. A rotational speed and a rotational direction of the motor M21 are controlled by the control unit CT.

The motor M21 is a step motor with a deceleration mechanism, for example.

Details of the transfer film driving unit KD21 will be described later.

The transfer film 21 is wound around and stretched between the supply bobbin 22 and the winding bobbin 23, and bridged over a prescribed running route as being guided by a plurality of guide shafts 24 between both bobbins.

A frame mark sensor 25 for cueing is arranged on a course of the running route of the transfer film 21.

The frame mark sensor 25 detects a frame mark 21*d* of the transfer film 21 (see FIG. 4), and sends out a frame mark detection information J2 (see FIG. 2) toward the control unit CT.

The transfer film 21 has an optical transparency. For example, the frame mark sensor 25 is made to be an optical sensor, the frame mark 21*d* is formed as a part for optically blocking, and the frame mark 21*d* is detected from a difference between transmitting light and blocking light.

Similarly, the ink film sensor 15 is made to be an optical sensor, the cueing mark 11*d* is formed as a part for optically blocking, and the cueing mark 11*d* is detected from a difference in an amount of transmission compared with a yellow ink layer Y that has an optical transparency.

A platen roller 26 that is rotated by driving a motor M26 is arranged between the frame mark sensor 25 and the supply bobbin 22 in the running route of the transfer film 21.

A rotational speed and a rotational direction of the motor M26 are controlled by the control unit CT.

Figure 5:
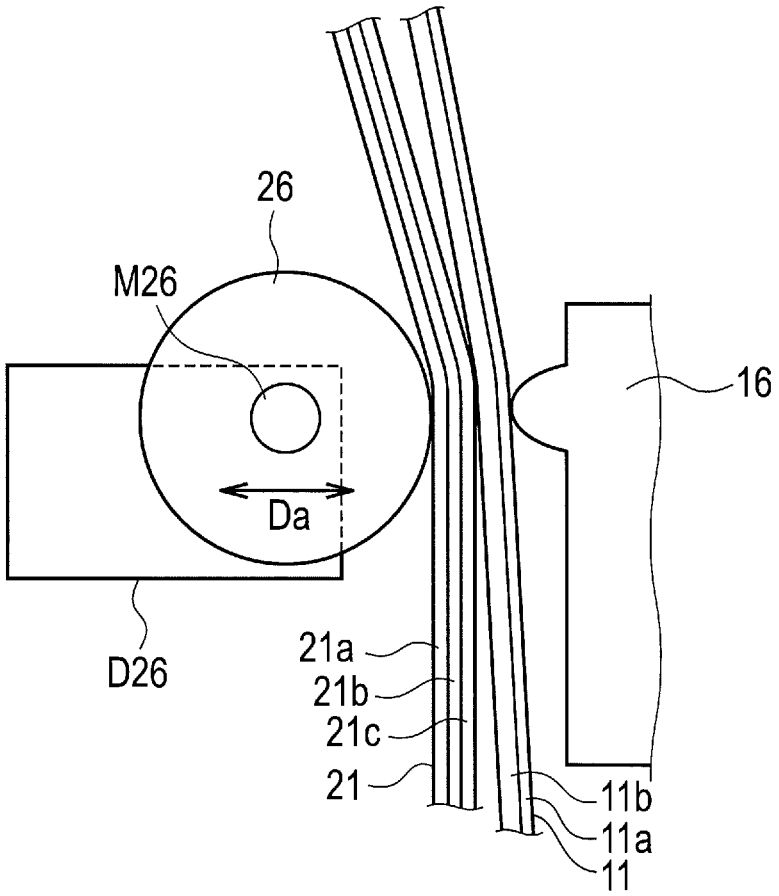
FIG. 5 is a diagram for explaining a pressed contact state of the ink film 11 and the transfer film 21 in the printing apparatus 51.

As also shown in FIG. 5 that is an enlarged view in vicinity of the platen roller 26, the platen roller 26 is separated/contacted from/to the transfer film 21 by an operation of a platen separation/contact driving unit D26, under the control of the control unit CT (an arrow Da).

More specifically, the platen roller 26 presses the transfer film 21 toward the thermal head 16, and moves between a pressed contact position (a position shown in FIG. 5) at which the transfer film 21 and the ink film 11 are held and put into pressed contact between the thermal head 16 and the platen roller 26 and a separated position (a position shown in FIG. 1) at which the platen roller 26 is separated from the transfer film 21. When the platen roller 26 is in the pressed contact position, the transfer to the transfer film 21 to be described below will be carried out.

The separation/contact operation of the platen roller 26 may be carried out on the thermal head 16 side, and it suffices for the thermal head 16 and the platen roller 26 to be separated/contacted relatively.

The ink film 11 and the transfer film 21 are made such that the winding to the winding bobbins 13, 23 side and the rewinding to the supply bobbin 12, 22 side can be respectively carried out independently, by the operations of the motor M11 and the motor M21 respectively, in a state where the platen roller 26 is in the separated position.

Also, the ink film 11 and the transfer film 21 are made such that they are movable to the winding bobbin 13, 23 side or the supply bobbin 12, 22 side while in close contact with each other, in a state where the platen roller 26 is in the pressed contact position.

This movement is carried out by the rotations of the supply bobbins 12, 22, the winding bobbins 13, 23 and the platen roller 26 by driving the motors M11, M21 and M26, under the control of the control unit CT.

Figure 2:
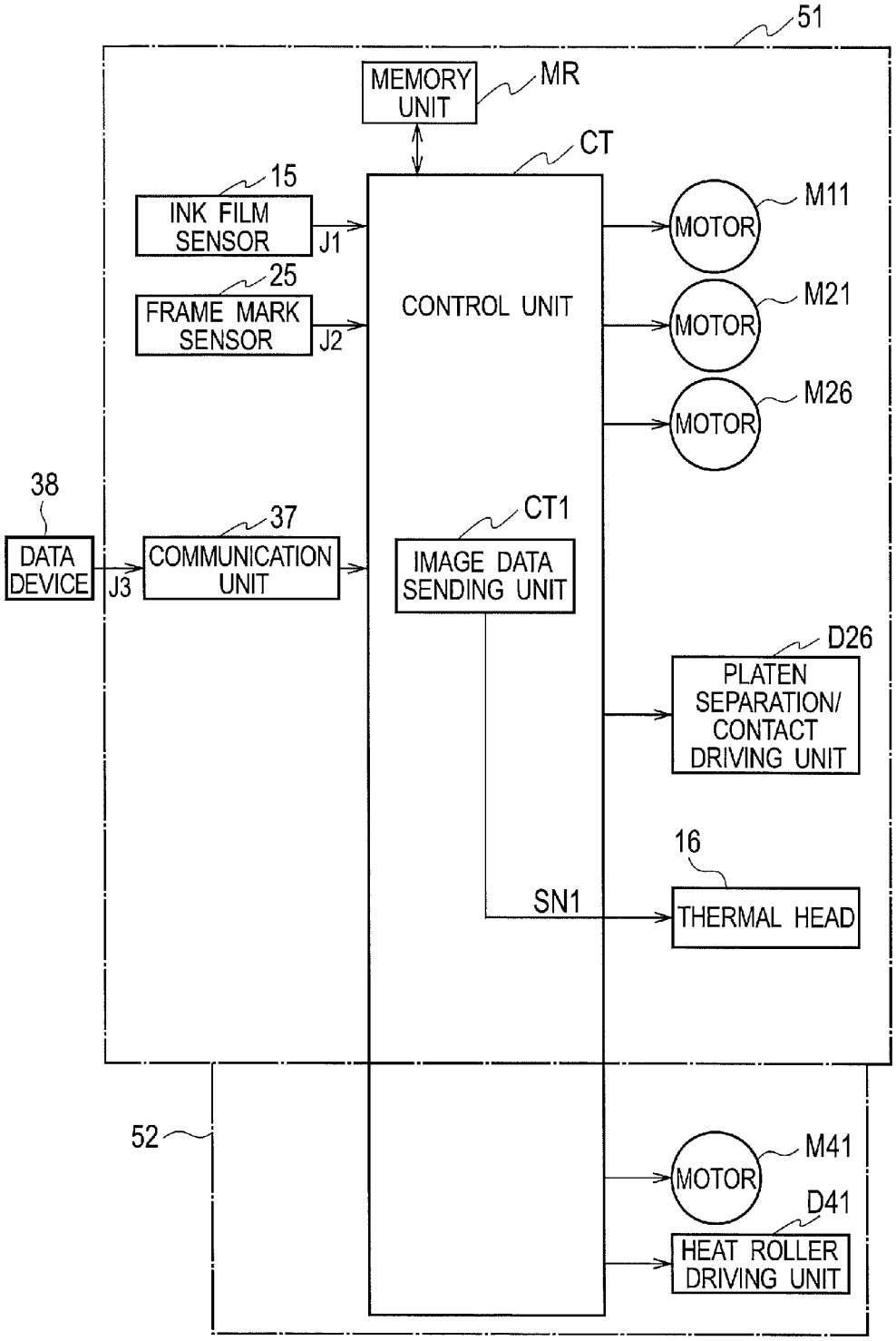
FIG. 2 is a block diagram showing a configuration of the printing apparatus 51.

As shown in FIG. 1 and FIG. 2, the control unit CT has an image data sending unit CT1.

The image data sending unit CT1 supplies image data SN1 to be transferred respectively to transfer frames F (see FIG. 4) of the transfer film 21, to the thermal head 16 at appropriate timing, when the platen roller 26 is in the pressed contact position. This timing is determined by the control unit CT as a whole according to the frame mark detection information J2 and the like.

The image data sending unit CT1 generates the image data SN1 according to a transfer image information J3 (see FIG. 2) that is incoming into a communication unit 37 provided in the printing apparatus 51 from an external data device 38 and the like.

Next, details of the ink film 11 and the transfer film 21 will be described with references to FIGS. 3A and 3B and FIGS. 4A and 4B.

Figure 3A:
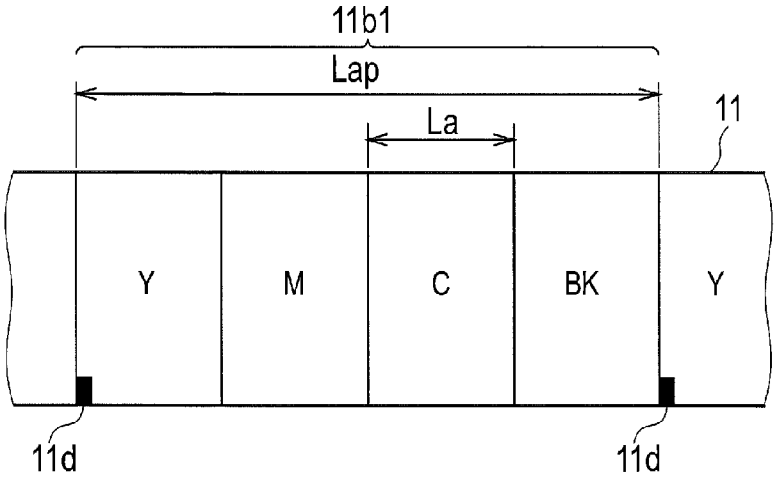
FIGS. 3A and 3B are diagrams for explaining an ink film 11 to be used in the printing apparatus 51.
Figure 3B:
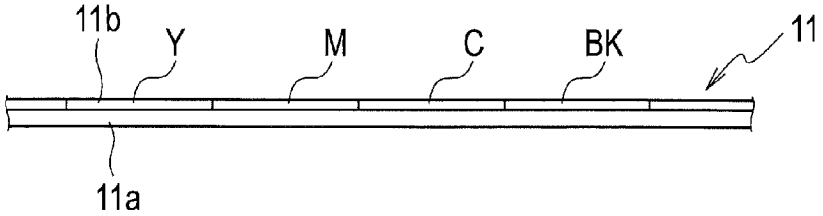

As shown in FIGS. 3A and 3B, the ink film 11 has a ribbon shaped ribbon base 11*a*, and an ink layer 11*b* formed by application on the ribbon base 11*a*.

The ink layer 11*b* is formed by repeatedly applying an ink set 11*b*1 that is a set of ink layers of a plurality of colors (four colors here) arranged in a ribbon direction.

The ink set 11*b*1 comprises a yellow ink layer Y, a magenta ink layer M, a cyan ink layer C, and a black ink layer BK, which are applied in the ribbon direction in this order.

The ink of each color is of the sublimation type. There are cases in which the melting type is used for the black.

The ink film 11 is set with respect to the printing apparatus 51 such that the order of colors of the ink layer 11*b* is the black ink layer BK, the cyan ink layer C, the magenta ink layer M and the yellow ink layer Y from the supply bobbin 12 side.

A cueing mark 11*d* is formed on one edge part of a boundary portion with the adjacent black ink layer BK in the yellow ink layer Y.

A length La in the ribbon direction of each ink layer Y, M, C and BK is the same each other. Consequently, a pitch Lap of the ink set 11*b*1 is set to be four times the length La.

A position of the ink film sensor 15 is set such that the pressed contact position of the thermal head 16 coincides with a position of a leading edge in a running direction of the yellow ink layer Y, when the ink film sensor 15 detects the cueing mark 11*d*.

Namely, a running route length from the pressed contact position to a detection position of the ink film sensor 15 is set to be an integer multiple of the pitch Lap.

Figure 4A:
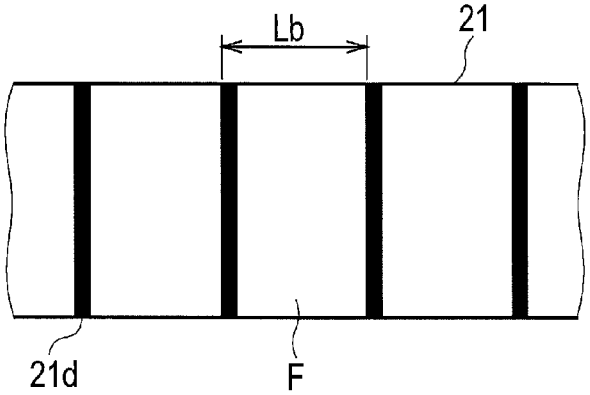
FIGS. 4A and 4B are diagrams for explaining a transfer film 21 to be used in the printing apparatus 51.
Figure 4B:
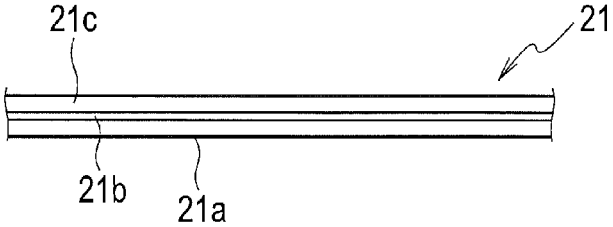

As shown in FIGS. 4A and 4B, the transfer film 21 has a ribbon shaped film base 21*a*, and a peeling layer 21*b* and a transfer image receiving layer 21*c*, which are formed by lamination on the film base 21*a*.

A width of the film base 21*a* is the same as a width of the ribbon base 11*a* of the ink film 11.

A frame mark 21*d* is repeatedly formed at a prescribed pitch Lb in the ribbon direction, on the film base 21*a* or the transfer image receiving layer 21*c*.

The frame mark 21*d* is formed over an entire width.

The pitch Lb is the same as the length La in the ink film 11 (La=Lb).

Regions partitioned in constant intervals at the pitch Lb in the transfer film 21 are transfer frames F. Namely, the frame mark 21*d* is assigned to a border portion of each transfer frame F, so that the transfer frames F are partitioned such that a plurality of them are arranged in the ribbon direction.

A position of the frame mark sensor 25 is set such that the pressed contact position of the platen roller 26 coincides with a position of a leading edge in a running direction of the frame mark 21*d*, when the frame mark sensor 25 detects the frame mark 21*d*.

Namely, a running route length from the pressed contact position to a detection position of the frame mark sensor 25 is set to be an integer multiple of the pitch Lb.

In the printing apparatus 51, the transfer film 21 and the ink film 11 are bridged over as shown in FIG. 5, in orientations in which the transfer image receiving layer 21*c* and the ink layer 11*b* are directly facing each other.

The transfer image receiving layer 21*c* has a property for receiving and fixing the ink of the ink layer 11*b* that is sublimated by heating. In the case where the ink of the black ink layer BK is of the melting type, the transfer image receiving layer 21*c* receives and fixes the black ink that is melted by heating.

In this way, in the pressed contact state of the platen roller 26 as shown in FIG. 5, the ink from the ink layer 11*b* that is in pressed contact with the transfer image receiving layer 21*c* is transferred, and an image is formed on the transfer image receiving layer 21*c*. The ink is transferred in a heating pattern according to the image data SN1 supplied to the thermal head 16.

The printing apparatus 51 makes the transfer of the ink of the ink layer 11*b* of the ink film 11 color by color, by appropriately heating a plurality of heating resistors 16*a* that are arranged in the thermal head 16, according to the image data SN1 to be transferred, while moving the ink film 11 and the transfer film 21 in close contact.

More specifically, the ink of the yellow ink layer Y, the ink of the magenta ink layer M, the ink of the cyan ink layer C, and the ink of the black ink layer BK are sequentially transferred in superposition to the transfer image receiving layer 21*c* of one transfer frame F of the transfer film 21.

A moving direction of each film at a time of carrying out this transfer is an up direction in FIG. 1.

Namely, it is a direction of winding to the winding bobbin 13 (a forward feeding direction) for the ink film 11, and it is a direction of rewinding to the supply bobbin 22 (a backward feeding direction) for the transfer film 21.

By this superposed transfer, it is possible to make the transfer printing of a desired color image (hereafter also referred to as an intermediate image P) on the transfer image receiving layer 21*c* in the prescribed transfer frame F.

In FIG. 1, the printing apparatus 51 has a re-transfer unit 52 for re-transferring a part of the intermediate image P formed on the transfer image receiving layer 21*c* of the transfer film 21 to a further object to be transferred.

In this example, an object to be transferred is a card 31. In FIG. 1, the card 31 during a transportation is indicated by a thick solid line.

An operation of the re-transfer unit 52 is controlled by the control unit CT.

The re-transfer unit 52 has a re-transfer block ST1 provided between the platen roller 26 and the winding bobbin 23 in the running route of the transfer film 21, a feeding block ST2 for feeding the card 31 to the re-transfer block ST1, and a take out block ST3 for taking out the card 31 that passed the re-transfer block ST1.

The re-transfer block ST1 has a heat roller 41 that is rotated by a motor M41, an opposing roller 42 that is arranged opposite to the heat roller 41, and a heat roller driving unit D41 for separating/contacting the heat roller 41 with respect to the opposing roller 42.

The feeding block ST2 has a posture conversion block ST2*a* for rotating a posture of the card 31 by 90° such that it is converted from a vertical direction to a horizontal direction, while holding the card 31.

More specifically, the feeding block ST2 has a stacker 32 for loading a plurality of cards 31 in vertical postures (standing postures). Also, the feeding block ST2 has a lifting roller 33 for rotating to lift the rightmost one in FIG. 1 upward, among the plurality of cards 31 that are loaded in the standing postures at the stacker 32.

The feeding block ST2 further has a pair of feeding rollers 34 for holding and feeding the card 31 lifted by the lifting roller 33 to the posture conversion block ST2*a* arranged on an upper side, and a plurality of pairs of transporting rollers 35 for transporting the card 31 that is converted into a horizontal posture by the posture conversion block ST2*a* to the re-transfer block ST1 on a left side.

An operation of the motor M41 is controlled by the control unit CT. Also, the lifting roller 33, the feeding rollers 34, and the transporting rollers 35 are rotated by driving motors not shown in the figure, respectively under the control of the control unit CT.

In this way, the re-transfer unit 52 converts one card 31 that is taken out to an upper side in the vertical posture from the stacker 32 in the feeding block ST2 to the horizontal posture at the posture conversion block ST2*a*, and transports and supplies this card 31 to the re-transfer block ST1.

In the re-transfer block ST1, the card 31 moves toward the take out block ST3 by driving the motor M41, while being in pressed contact and held with the transfer film 21 between the temperature increased heat roller 41 and the opposing roller 42, by the operation of the heat roller driving unit D41. To the card 31, the transfer image receiving layer 21*c* of the transfer film 21 is put in pressed contact.

With this pressed contact moving, a range of a part of the intermediate image P formed on the transfer image receiving layer 21*c* by the printing apparatus 51 is transferred to the card 31. Namely, the re-transferred image is formed by printing on a surface of the card 31.

The card 31 with the re-transferred image printed thereon is transported to the take out block ST3. In the take out block ST3, a correcting roller set 45 that is a set of a correcting heat roller 43 for correcting a warping of the card 31 and a correcting opposing roller 44 for opposing the correcting heat roller 43 is provided.

The card 31 with the re-transfer image formed thereon has its warping corrected by being heated and transported through the correcting roller set 45, and then accumulated and stored in an external stocker 36, for example.

The operation timings of the transfer to the transfer film 21 and the re-transfer to the card 31 are not limited. Once the intermediate image P is formed in one transfer frame F, the re-transfer may be carried out before forming the intermediate image P in next transfer frame F.

Also, after forming the intermediate images P in a plurality of the transfer frames F together, the re-transfer may be carried out for all of the intermediate images P or for a selected part of the intermediate images P.

The printing apparatus 51 has a memory unit MR and a communication unit 37, along with the control unit CT. The memory unit MR stores in advance an operation program for carrying out the operation of the printing apparatus 51 as a whole, a transfer image information J3 that is an information of the image to be transferred, and the like. The memory contents of the memory unit MR are appropriately referred by the control unit CT.

The operation program and the transfer image information J3 are supplied to the control unit CT via the communication unit 37 from an external data device 38 and the like (see FIG. 2), and stored in the memory unit MR.

Next, the ink film driving unit KD11 and the transfer film driving unit KD21 will be described in detail with references mainly to FIG. 6 to FIG. 8.

The ink film driving unit KD11 is configured to rotate two bobbins on which the ink film 11 is bridged over, i.e., the supply bobbin 12 and the winding bobbin 13, by driving one motor M11.

The transfer film driving unit KD21 is configured to rotate two bobbins on which the transfer film 21 is bridged over, i.e., the supply bobbin 22 and the winding bobbin 23, by driving one motor M21.

First, the ink film driving unit KD11 will be described with references to FIG. 6 and FIG. 7.

Figure 6:
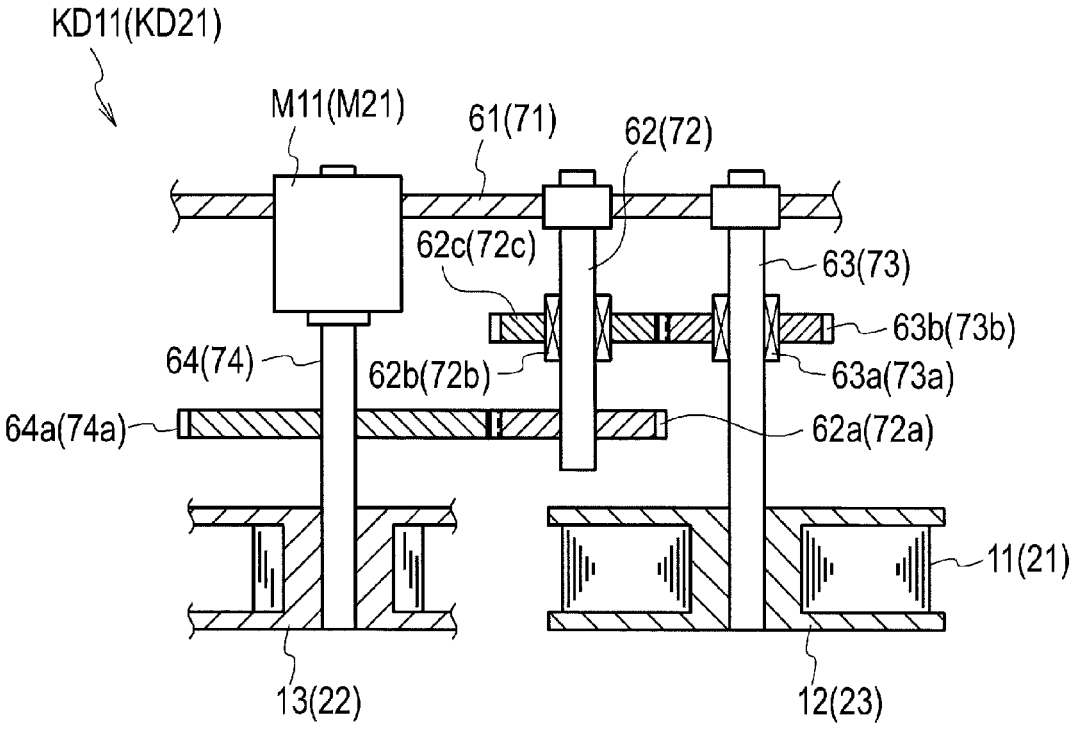
FIG. 6 is a schematic side view for explaining an ink film driving unit KD11 and a transfer film driving unit KD21 in the printing apparatus 51.
Figure 7:
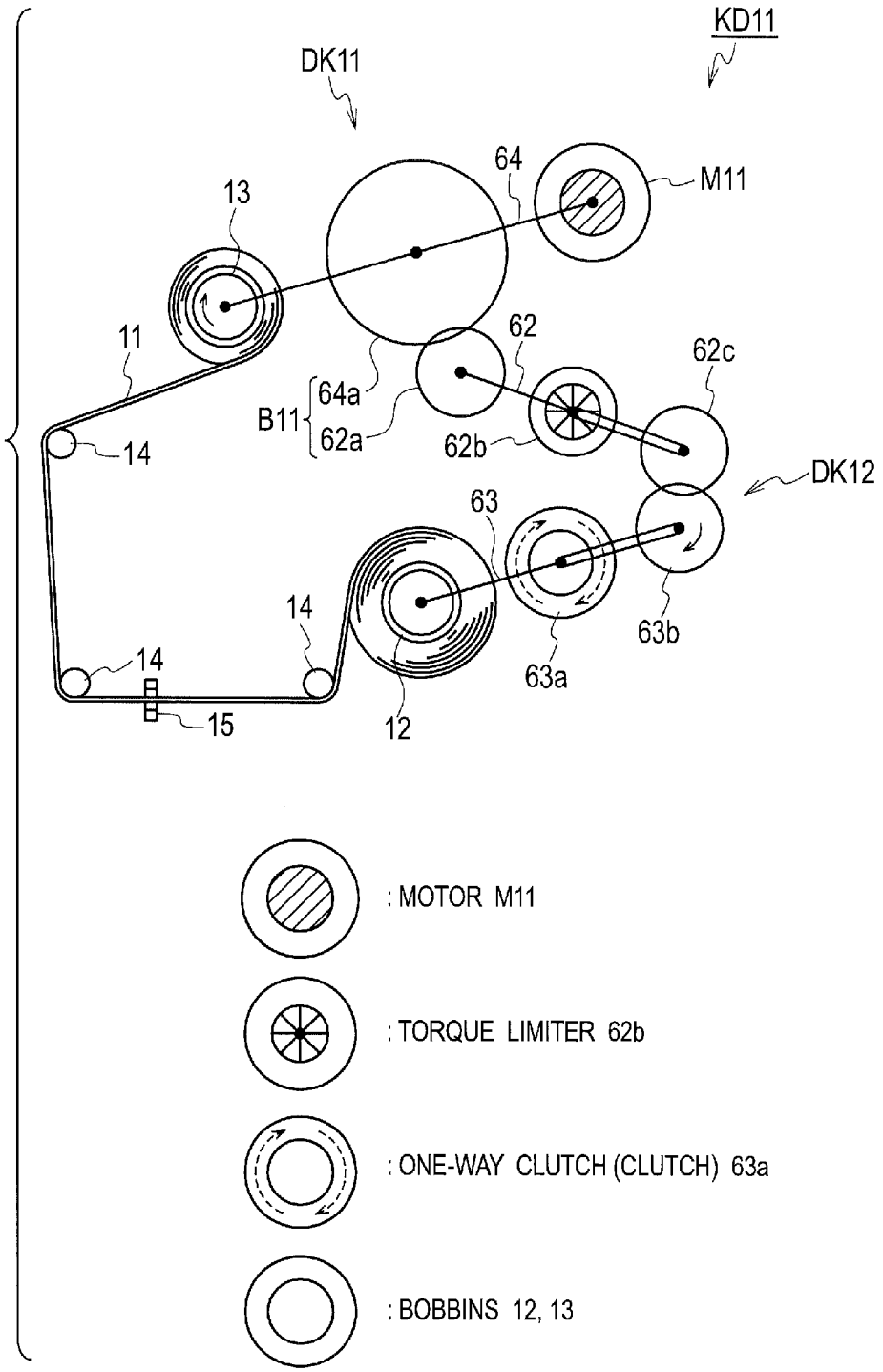
FIG. 7 is a schematic plan view for explaining a configuration of the ink film driving unit KD11.

FIG. 6 is a schematic side view for explaining a configuration of the ink film driving unit KD11, and FIG. 7 is its schematic plan view.

In FIG. 6 and FIG. 7, schematic notations that are partially different from an actual arrangement are employed in order to make a transmission route of a torque generated by the motor M11 easily comprehensible.

In particular, in FIG. 7, centers of members attached to the same shaft that are integrally rotating with that shaft are connected together by solid lines. The solid lines imply the shafts.

Also, centers of members that are mutually coupled but not necessarily integrally rotating are connected together by double solid lines. Moreover, the overlap of shaft directions and the relationship of coupling of diameter directions are shown in the planar development.

The motor M11 is integrally fixed to a frame 61 that is a base body of the ink film driving unit KD11, and an intermediate driven shaft 62 and a bobbin driven shaft 63 are supported to be freely rotatable.

A driving gear 64*a* and the winding bobbin 13 are fixed to a driving shaft 64 of the motor M11 such that they are integrally rotated with the driving shaft 64.

A driven gear 62*a* with a smaller diameter (a less number of teeth) than the driving gear 64*a* that is engaged with the driving gear 64*a* is fixed to the intermediate driven shaft 62.

Also, a TR gear 62*c* of the same diameter as the driven gear 62*a* is attached to the intermediate driven shaft 62 via a torque limiter 62*b*.

In FIG. 7, as mentioned above, the intermediate driven shaft 62 and the bobbin driven shaft 63 are indicated by solid lines that imply the shafts, and a coupling of the torque limiter 62*b* and the TR gear 62*c* is indicated by a double solid line.

The torque limiter 62*b* is made to transmit a rotational torque of a prescribed upper limit by running idly, in the case where a rotational torque in excess of a prescribed value is generated between the intermediate driven shaft 62 and the TR gear 62*c*.

To the bobbin driven shaft 63, the supply bobbin 12 is integrally fixed and a clutch gear 63*b* is attached via a one-way clutch 63*a* (hereafter referred to as a clutch 63*a*). The clutch gear 63*b* is engaged with the TR gear 62*c*.

In FIG. 7 (as well as in FIG. 1), in the case where the clutch gear 63*b* is rotated in the clockwise direction with respect to the bobbin driven shaft 63, the clutch 63*a* transmits that rotation to the bobbin driven shaft 63 by being coupled integrally.

Also, in the case where the clutch gear 63*b* is rotated in the counterclockwise direction, the clutch 63*a* is made not to transmit that rotation to the bobbin driven shaft 63 by running idly (the rotation transmission direction is indicated by dashed line arrows in FIG. 7).

As should be apparent from the above described configuration, the ink film driving unit KD11 has a transmission route portion DK11 for transmitting the torque generated by one motor M11 to the winding bobbin 13, and a transmission route portion DK12 for transmitting the torque generated by one motor M11 to the supply bobbin 12.

The transmission route portion DK11 and the transmission route portion DK12 are branching at a branching portion B11. The branching portion B11 is configured to include the driving gear 64*a* and the driven gear 62*a*.

The transmission route portion DK11 is a route reaching from the motor M11 through the driving shaft 64 to the winding bobbin 13.

The transmission route portion DK12 is a route reaching from the motor M11 through the driving shaft 64, the driving gear 64*a*, the driven gear 62*a*, the intermediate driven shaft 62, the torque limiter 62*b*, the TR gear 62*c*, the clutch gear 63*b*, the clutch 63*a* and the bobbin driven shaft 63 to the supply bobbin 12.

The transmission route portion DK11 always transmits the torque generated by the motor M11 to the winding bobbin 13.

The transmission route portion DK12 selectively transmits the torque generated by the motor M11 to the supply bobbin 12.

A configuration of the transfer film driving unit KD21 is basically the same as the ink film driving unit KD11, and will be described with references to FIG. 6 and FIG. 8. As far as FIG. 6 is concerned, those reference numerals with parentheses ( ) correspond to the transfer film driving unit KD21.

Namely, the motor M21 is integrally fixed to a frame 71 that is a base body of the transfer film driving unit KD21, and an intermediate driven shaft 72 and a bobbin driven shaft 73 are supported to be freely rotatable.

A driving gear 74*a* and the supply bobbin 22 are fixed to a driving shaft 74 of the motor M21 such that they are integrally rotated with the driving shaft 74.

A driven gear 72*a* with a smaller diameter (a less number of teeth) than the driving gear 74*a* that is engaged with the driving gear 74*a* is fixed to the intermediate driven shaft 72.

Also, a TR gear 72*c* of the same diameter as the driven gear 72*a* is attached to the intermediate driven shaft 72 via a torque limiter 72*b*.

Figure 8:
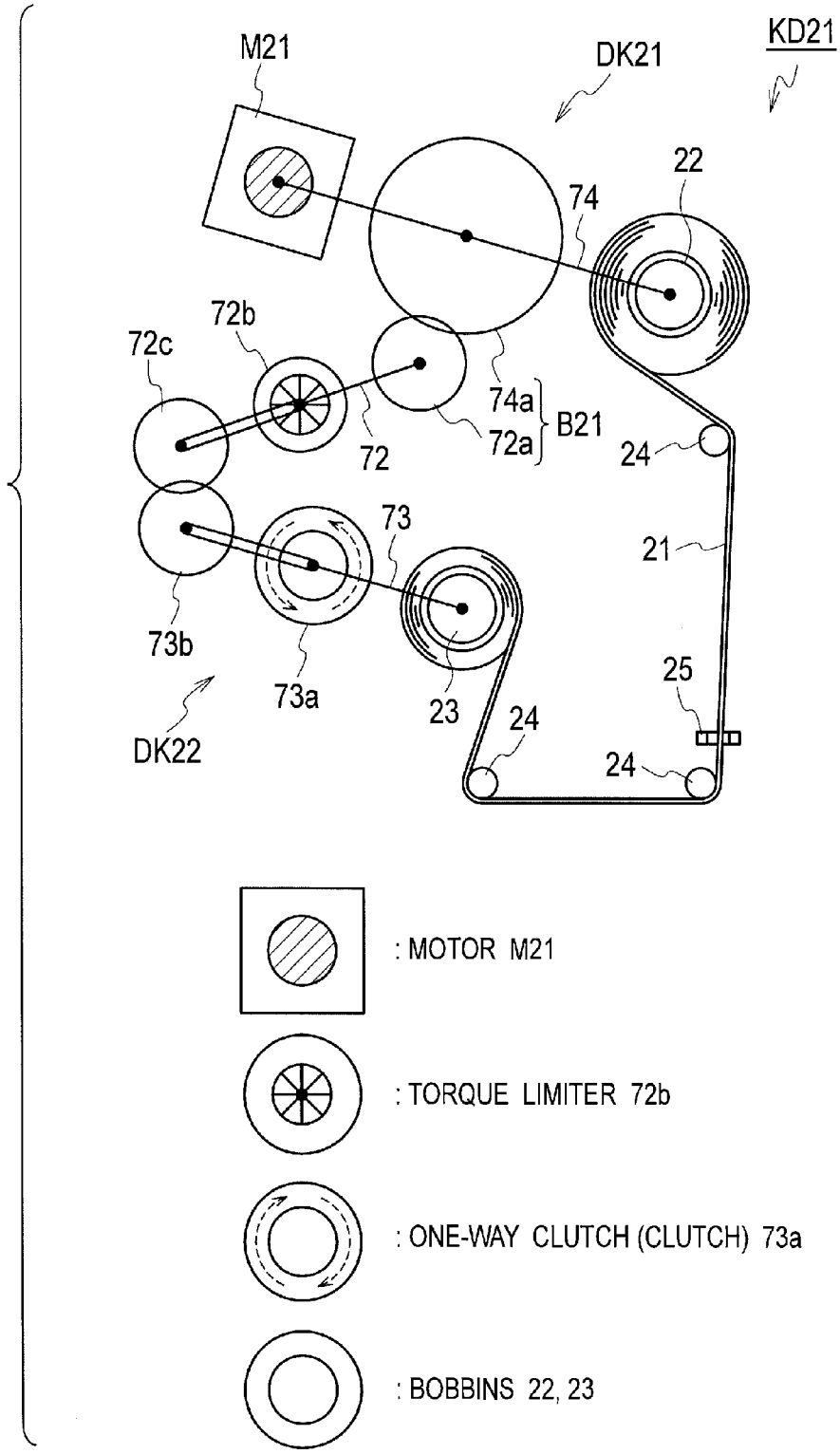
FIG. 8 is a schematic plan view for explaining a configuration of the transfer film driving unit KD21.

In FIG. 8, as mentioned above, the intermediate driven shaft 72 and the bobbin driven shaft 73 are indicated by solid lines that imply the shafts, and a coupling of the torque limiter 72*b* and the TR gear 72*c* is indicated by a double solid line.

The torque limiter 72*b* is made to transmit a rotational torque of a prescribed upper limit by running idly, in the case where a rotational torque in excess of a prescribed value is generated between the intermediate driven shaft 72 and the TR gear 72*c*.

To the bobbin driven shaft 73, the winding bobbin 23 is integrally fixed and a clutch gear 73*b* is attached via a one-way clutch 73*a* (hereafter referred to as a clutch 73*a*). The clutch gear 73*b* is engaged with the TR gear 72*c*.

In FIG. 8 (as well as in FIG. 1), in the case where the clutch gear 73*b* is rotated in the counterclockwise direction with respect to the bobbin driven shaft 73, the clutch 73*a* transmits that rotation to the bobbin driven shaft 73 by being coupled integrally.

Also, in the case where the clutch gear 73*b* is rotated in the clockwise direction, the clutch 73*a* is made not to transmit that rotation to the bobbin driven shaft 73 by running idly (the rotation transmission direction is indicated by dashed line arrows in FIG. 8).

As mentioned above, the transfer film driving unit KD21 has a transmission route portion DK21 for transmitting the torque generated by one motor M21 to the supply bobbin 22, and a transmission route portion DK22 for transmitting the torque generated by one motor M21 to the winding bobbin 23.

The transmission route portion DK21 and the transmission route portion DK22 are branching at a branching portion B21. The branching portion B21 is configured to include the driving gear 74*a* and the driven gear 72*a*.

The transmission route portion DK21 is a route reaching from the motor M21 through the driving shaft 74 to the supply bobbin 22.

The transmission route portion DK22 is a route reaching from the motor M21 through the driving shaft 74, the driving gear 74*a*, the driven gear 72*a*, the intermediate driven shaft 72, the torque limiter 72*b*, the TR gear 72*c*, the clutch gear 73*b*, the clutch 73*a* and the bobbin driven shaft 73 to the winding bobbin 23.

The transmission route portion DK21 always transmits the torque generated by the motor M21 to the supply bobbin 22.

The transmission route portion DK22 selectively transmits the torque generated by the motor M21 to the winding bobbin 23.

With the configuration as described above, the printing apparatus 51 is made to optimally move the ink film 11 and the transfer film 21, by driving the motor M11 and the motor M21 that are provided in correspondence respectively, in the transfer operation and the re-transfer operation.

Here, the operation of the printing apparatus 51 is divided into the following four operations in time series: (A: a transfer printing of Y ink and card feeding operation), (B: a next color transfer cueing operation), (C: a re-transfer operation), and (D: an unused transfer frame cueing operation), and these operations will be described sequentially with references to FIG. 9 to FIG. 12. The operations to be described below are carried out under the control of the control unit CT.

(A: An Ink Transfer Operation: See Mainly FIG. 6 and FIG. 9)

As described above, the transfer printing of the intermediate image P with respect to the transfer film 21 is carried out by the superposed transfer of respective inks of the yellow ink layer Y, the magenta ink layer M, the cyan ink layer C, and the black ink layer BK in this order, with respect to one transfer frame F.

The first transfer of the yellow ink is carried out after the cueing operation of the yellow ink layer Y on the ink film 11 and the transfer frame F on the transfer film 21 to be described later.

First, the control unit CT presses the platen roller 26 to the thermal head 16 by operating the platen separation/contact driving unit D26 (a white arrow Db).

In this way, the transfer leading position of the yellow ink layer Y and the leading position to be transferred of the transfer frame F are in pressed contact.

For the ink film 11, the control unit CT rotates the motor M11 in the counterclockwise direction (an arrow Dc). In this way, the driving gear 64*a* and the winding bobbin 13 that are fixed to the driving shaft 64 of the motor M11 are rotated in the same counterclockwise direction as the driving shaft 64.

By the rotation of the driving gear 64*a*, the driven gear 62*a* that is engaged with the driving gear 64*a* is rotated in the clockwise direction (an arrow De). In this way, the intermediate driven shaft 62 that is integral to the driven gear 62*a* is rotated in the clockwise direction, and the torque limiter 62*b* that is attached to the intermediate driven shaft 62 also tries to rotate in the clockwise direction.

At this point, on the driving members subsequent to the TR gear 62*c* that is attached to the torque limiter 62*b*, i.e., the TR gear 62*c*, the clutch gear 63*b*, the clutch 63*a*, the bobbin driven shaft 63, and the supply bobbin 12, no torque for preventing the rotation in the clockwise direction of the intermediate driven shaft 62 is generated, so that the torque limiting function of the torque limiter 62*b* will not be activated. For this reason, the rotation of the driven gear 62*a* is transmitted to the TR gear 62*c* via the torque limiter 62*b* without any change.

The TR gear 62*c* that is engaged with the clutch gear 63*b* is rotated in the counterclockwise direction (an arrow Df).

On the other hand, due to the rotation in the counterclockwise direction (an arrow Dc) of the winding bobbin 13, the ink film 11 is pulled into a direction of feeding out (an arrow Dg) from the supply bobbin 12.

Here, the gear ratio of the driving gear 64*a* and the driven gear 62*a* is set such that the number of rotations of the clutch gear 63*b* becomes greater (higher speed) than the number of rotations of the supply bobbin 12 that is rotated as the ink film 11 is pulled by the winding bobbin 13, even in the case where the ink film 11 wound around the supply bobbin 12 has the minimum amount of windings (minimum diameter).

Namely, the number of rotations in the counterclockwise direction of the clutch gear 63*b* will become greater (higher speed) than the number of rotations in the counterclockwise direction of the supply bobbin 12 and the bobbin driven shaft 63 that are rotated as the ink film 11 is pulled by the winding bobbin 13.

In this way, the clutch 63*a* is given a relative rotation in a reverse direction from the rotational direction for transmitting a force that is set in advance, so that the clutch 63*a* will run idly.

For this reason, in the movement of the ink film 11 for winding to the winding bobbin 13, substantially no back tension due to the supply bobbin 12 is exerted on the ink film 11.

For the transfer film 21, the control unit CT rotates the motor M21 in the clockwise direction (an arrow Dd). In this way, the driving gear 74*a* and the supply bobbin 22 that are fixed to the driving shaft 74 of the motor M21 are rotated in the same clockwise direction as the driving shaft 74.

By the rotation of the driving gear 74*a*, the driven gear 72*a* that is engaged with the driving gear 74*a* is rotated in the counterclockwise direction (an arrow Dh). In this way, the intermediate driven shaft 72 that is integral to the driven gear 72*a* is rotated in the counterclockwise direction, and the torque limiter 72*b* that is attached to the intermediate driven shaft 72 also tries to rotate in the counterclockwise direction.

At this point, on the driving members subsequent to the TR gear 72*c* that is attached to the torque limiter 72*b*, i.e., the TR gear 72*c*, the clutch gear 73*b*, the clutch 73*a*, the bobbin driven shaft 73, and the winding bobbin 23, no torque for preventing the rotation in the counterclockwise direction of the intermediate driven shaft 72 is generated, so that the torque limiting function of the torque limiter 72*b* will not be activated. For this reason, the rotation of the driven gear 72*a* is transmitted to the TR gear 72*c* via the torque limiter 72*b* without any change.

The TR gear 72*c* that is engaged with the clutch gear 73*b* is rotated in the clockwise direction (an arrow Dj).

On the other hand, due to the rotation in the clockwise direction (an arrow Dd) of the supply bobbin 22, the transfer film 21 is pulled into a direction of rewinding (an arrow Dk) from the winding bobbin 23.

Here, the gear ratio of the driving gear 74*a* and the driven gear 72*a* is set such that the number of rotations of the clutch gear 73*b* becomes greater (higher speed) than the number of rotations of the winding bobbin 23 that is rotated as the transfer film 21 is pulled by the supply bobbin 22, even in the case where the transfer film 21 wound around the winding bobbin 23 has the minimum amount of windings (minimum diameter).

Namely, the number of rotations in the clockwise direction of the clutch gear 73*b* will become greater (higher speed) than the number of rotations in the clockwise direction of the winding bobbin 23 and the bobbin driven shaft 73 that are rotated as the transfer film 21 is pulled by the supply bobbin 22.

In this way, the clutch 73*a* is given a relative rotation in a reverse direction from the rotational direction for transmitting a force that is set in advance, so that the clutch 73*a* will run idly.

For this reason, in the movement of the transfer film 21 for rewinding to the supply bobbin 22, substantially no back tension due to the winding bobbin 23 is exerted on the transfer film 21.

As described above, the ink film 11 and the transfer film 21 are moved such that the ink film 11 is wound to the winding bobbin 13 and the transfer film 21 is rewound to the supply bobbin 22, while put in thermal pressed contact by the platen roller 26 and the thermal head 16, in a state of not exerted with any back tension.

This moving distance is approximately one transfer frame F part. In conjunction with this moving, the image data SN1 to be transferred is sent to the thermal head 16 from the image data sending unit CT1, and the transfer printing of the ink of the yellow ink layer Y with respect to the transfer frame F is carried out. In this way, an image of the yellow component in the intermediate image P is formed on the transfer frame F.

In the ink transfer operation with respect to the transfer film 21, if the back tension is given to the ink film 11 or the transfer film 21, when the magnitude of the back tension is varied even slightly, the moving speed of the ink film 11 or the transfer film 21 would be varied, so that there is a concern for causing an uneven transfer.

In the printing apparatus 51, the back tension exerted on the ink film 11 and the transfer film 21 becomes substantially zero in the ink transfer operation, as described above.

In this way, the moving speed of the ink film 11 and the transfer film 21 is maintained stably without any variation, so that there is no concern for causing an uneven transfer.

The ink film 11 and the transfer film 21 that passed the thermal head 16 will be in a state in which the transferred portions are loosely stuck together by the thermal pressed contact. Consequently, they will move in close contact even after passing the thermal head 16.

These portions that are put in close contact by the transfer will be separated as they are pulled in mutually different directions at a position past the guide shafts 14, 24 (a separation position PTa).

The control unit CT continues to move the ink film 11 and the transfer film 21 even after the transfer printing of the ink is finished, until these portions in close contact are passing the separation position PTa and completely separated.

When the portions in close contact are completely separated, a transfer start position PM for the magenta ink layer M that is a next transfer ink layer in the ink film 11 is already past the thermal head 16 and positioned at an upper side in FIG. 1 than the thermal head 16.

On the other hand, the control unit CT carries out a re-transfer waiting operation for the cards 31, in parallel to the ink transfer operation from the yellow ink layer Y.

More specifically, a rightmost one (FIG. 9: a card 31A) of the cards 31 that are vertically stacked in the stacker 32 in FIG. 1 is lifted by the lifting roller 33 and supplied to the posture conversion block ST2*a*.

Figure 9:
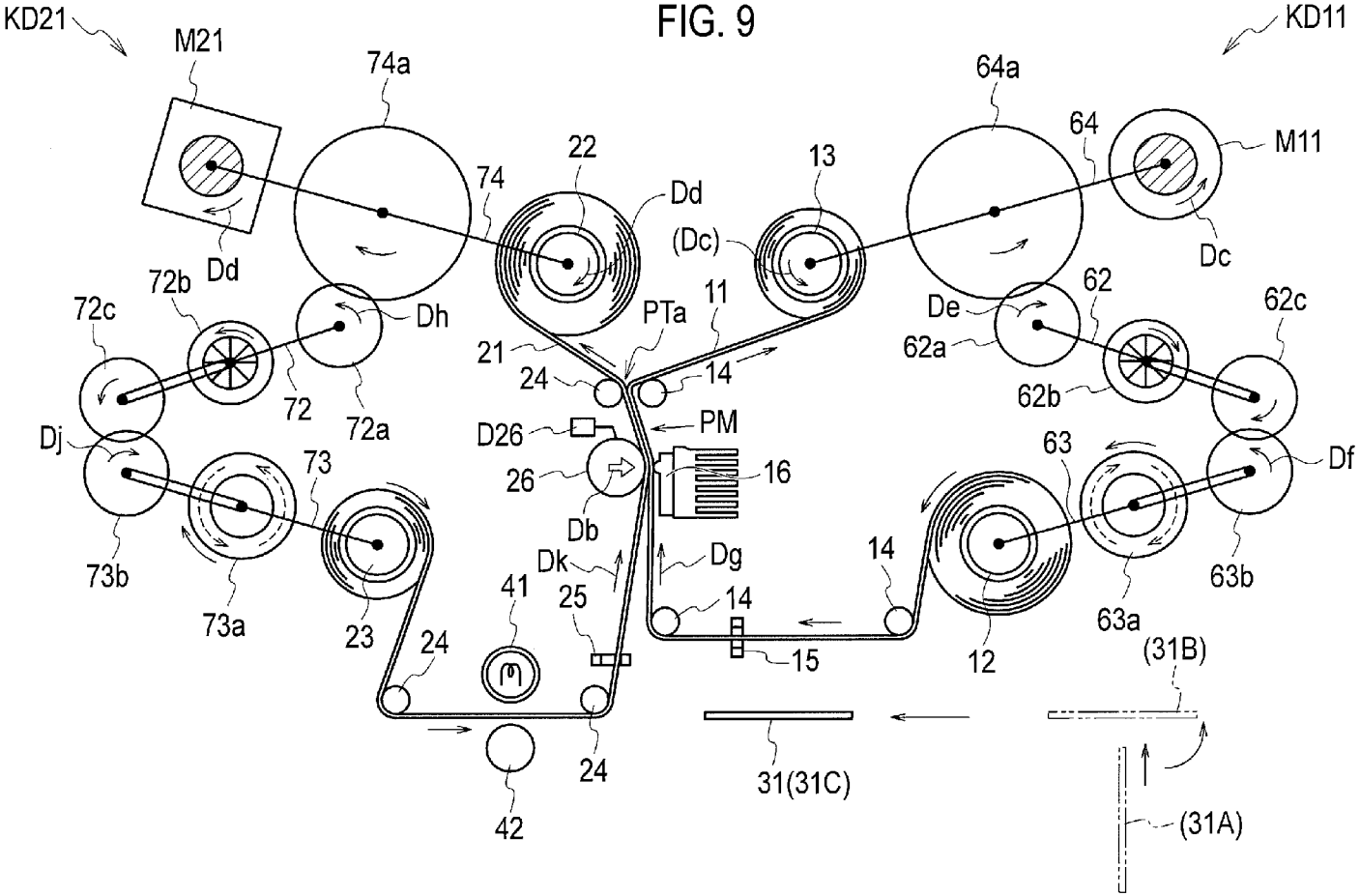
FIG. 9 is a schematic plan view for explaining (A: an ink transfer operation) in the operation of the printing apparatus 51.

At the posture conversion block ST2*a*, after the supplied card 31 is rotated into a horizontal posture (FIG. 9: a card 31B), this card 31B is held by the transporting rollers 35 of the feeding block ST2 and placed at a re-transfer waiting position in the re-transfer block ST1 (see FIG. 9: a card 31C).

(B: A Next Color Transfer Cueing Operation: See FIG. 6 and FIG. 10)

As described above, at a time of finishing the ink transfer operation for the yellow ink layer Y, more specifically at a time of completing the separation of the portions in close contact, the position of the thermal head 16 is at a lower side than the transfer start position PM for the magenta ink layer M that is the next transfer color.

Consequently, at a time of cueing the magenta ink layer M, the rewinding (the winding to the supply bobbin 12) of the ink film 11 is carried out, so as to move the transfer start position PM to the position of the thermal head 16.

Also, the winding (the winding to the winding bobbin 23) of the transfer film 21 for the pitch Lb part corresponding to the ribbon direction length of the transfer frame F is carried out to perform the re-cueing of the transfer film 21, in order to make the superposed transfer of the ink of the magenta ink layer M with respect to the transfer frame F on which the ink of the yellow ink layer Y has been transferred.

The control unit CT carries out an accurate cueing of the ink film 11 and the transfer film 21 according to the ink film mark detection information J1 and the frame mark detection information J2 from the ink film sensor 15 and the frame mark sensor 25.

Figure 10:
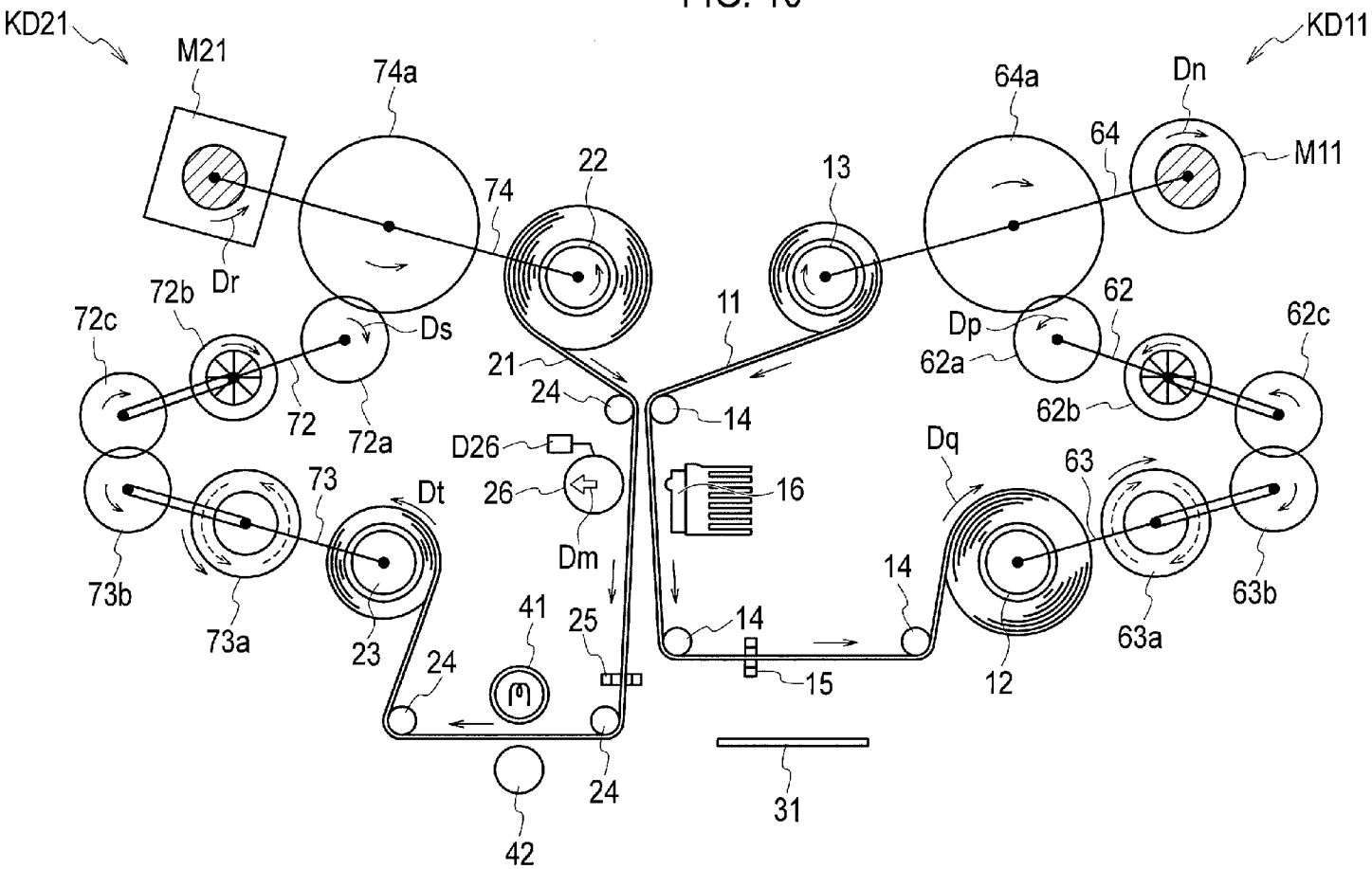
FIG. 10 is a schematic plan view for explaining (B: a next color transfer cueing operation) in the operation of the printing apparatus 51.

This cueing operation will be described with reference to FIG. 10 mainly.

First, the control unit CT moves the platen roller 26 to the separated position as indicated by a white arrow Dm, by operating the platen separation/contact driving unit D26. In this way, the ink film 11 and the transfer film 21 that had been put in pressed contact are separated.

For the ink film 11, the control unit CT rotates the motor M11 in the clockwise direction (see an arrow Dn). By this rotation, the driving gear 64*a* and the winding bobbin 13 that are fixed to the driving shaft 64 of the motor M11 are rotated in the same clockwise direction as the driving shaft 64.

By the rotation in the clockwise direction of the winding bobbin 13, the ink film 11 is fed out toward the supply bobbin 12.

On the other hand, by the rotation of the driving gear 64*a*, the driven gear 62*a* that is engaged with the driving gear 64*a* is rotated with a greater number of rotations than the driving gear 64*a* in the counterclockwise direction (an arrow Dp). In this way, the intermediate driven shaft 62 that is integral to the driven gear 62*a* is rotated in the counterclockwise direction, and the torque limiter 62*b* that is attached to the intermediate driven shaft 62 and the TR gear 62*c* that is coupled with the torque limiter 62*b* are also rotated in the counterclockwise direction.

The clutch gear 63*b* that is engaged with the TR gear 62*c* is rotated in the clockwise direction.

Here, the supply bobbin 12 is not pulled by the ink film 11, so that the supply bobbin 12 can freely rotate integrally with the bobbin driven shaft 63.

For this reason, the clutch 63*a* is given a relative rotation in the clockwise direction that is a direction for transmitting a force that is set in advance, by the clutch gear 63*b*, so that the rotational force in the clockwise direction is transmitted by the torque with a value specified by the torque limiter 62*b* as an upper limit, to the bobbin driven shaft 63 and the supply bobbin 12.

In this way, the supply bobbin 12 tries to rotate in the clockwise direction (an arrow Dq) at a greater number of rotations than the winding bobbin 13, so that the ink film 11 is wound to the supply bobbin 12 in a state where a back tension of a strength according to a difference in the numbers of rotations between two bobbins is given.

The control unit CT stops the motor M11 at a prescribed cueing position.

In this winding, the tension exerted on the ink film 11 is substantially maintained at a value corresponding to the specified upper limit value of the torque limiter 62*b*.

Consequently, the cueing operation for the ink layer of the color to be transferred next is carried out without slacking the ink film 11, so that the positioning (the cueing of the ink layer of the next transfer color) can be made in high precision.

For the transfer film 21, the control unit CT rotates the motor M21 in the counterclockwise direction (see an arrow Dr). By this rotation, the driving gear 74*a* and the supply bobbin 22 that are fixed to the driving shaft 74 of the motor M21 are rotated in the same counterclockwise direction as the driving shaft 74.

By the rotation in the counterclockwise direction of the supply bobbin 22, the transfer film 21 is fed out toward the winding bobbin 23.

On the other hand, by the rotation of the driving gear 74*a*, the driven gear 72*a* that is engaged with the driving gear 74*a* is rotated with a greater number of rotations than the driving gear 74*a* in the clockwise direction (an arrow Ds). In this way, the intermediate driven shaft 72 that is integral to the driven gear 72*a* is rotated in the clockwise direction, and the torque limiter 72*b* that is attached to the intermediate driven shaft 72 and the TR gear 72*c* that is coupled with the torque limiter 72*b* are also rotated in the clockwise direction.

The clutch gear 73*b* that is engaged with the TR gear 72*c* is rotated in the counterclockwise direction.

Here, the winding bobbin 23 is not pulled by the transfer film 21, so that the winding bobbin 23 can freely rotate integrally with the bobbin driven shaft 73.

For this reason, the clutch 73*a* is given a relative rotation in the counterclockwise direction that is a direction for transmitting a force that is set in advance, by the clutch gear 73*b*, so that the rotational force in the counterclockwise direction is transmitted by the torque with a value specified by the torque limiter 72*b* as an upper limit, to the bobbin driven shaft 73 and the winding bobbin 23.

In this way, the winding bobbin 23 tries to rotate in the counterclockwise direction (an arrow Dt) at a greater number of rotations than the supply bobbin 22, so that the transfer film 21 is wound to the winding bobbin 23 in a state where a back tension of a strength according to a difference in the numbers of rotations between two bobbins is given.

The control unit CT stops the motor M21 at a prescribed cueing position.

In this winding, the tension exerted on the transfer film 21 is substantially maintained at a value corresponding to the specified upper limit value of the torque limiter 72*b*.

Consequently, the cueing operation for the transfer frame F to make the superposed transfer is carried out without slacking the transfer film 21, so that the positioning (the cueing for the superposed transfer to the transfer frame on which the ink has already been transferred) can be made in high precision.

The ink superposed transfer operation from the cyan ink layer C and the black ink layer BK after the ink superposed transfer of the magenta ink layer M is performed by respectively carrying out (A: an ink transfer operation) and (B: a next color transfer cueing operation) described above.

By the superposed transfer of the ink of four colors, the intermediate image P is transfer printed on the transfer frame.

As described above, the printing apparatus 51 can re-transfer a part of the formed intermediate image P, onto the card 31.

Next, this re-transfer operation will be described with reference to FIG. 11 mainly.

(C: A Re-Transfer Operation: FIG. 1, FIG. 6 and FIG. 11)

In the re-transfer operation, first, the cueing operation for the transfer film 21 and the card 31 that is the object to be re-transferred is carried out.

More specifically, in the transfer film 21, a re-transfer start position of the transfer frame F on which the intermediate image P has been transfer printed and a re-transfer start position of the card 31 on which the intermediate image P is to be re-transfer printed are aligned with a prescribed cueing position in the re-transfer block ST1.

The control unit CT carries out this cueing movement of the transfer film 21, similarly as in (B: a next color transfer cueing operation). Consequently, in the re-transfer cueing operation for the transfer frame F, a tension is given to the transfer film 21 with a value corresponding to the specified upper limit value of the torque limiter 72*b*. In this way, in the cueing movement, the positioning can be made in high precision without slacking the transfer film 21.

Figure 11:
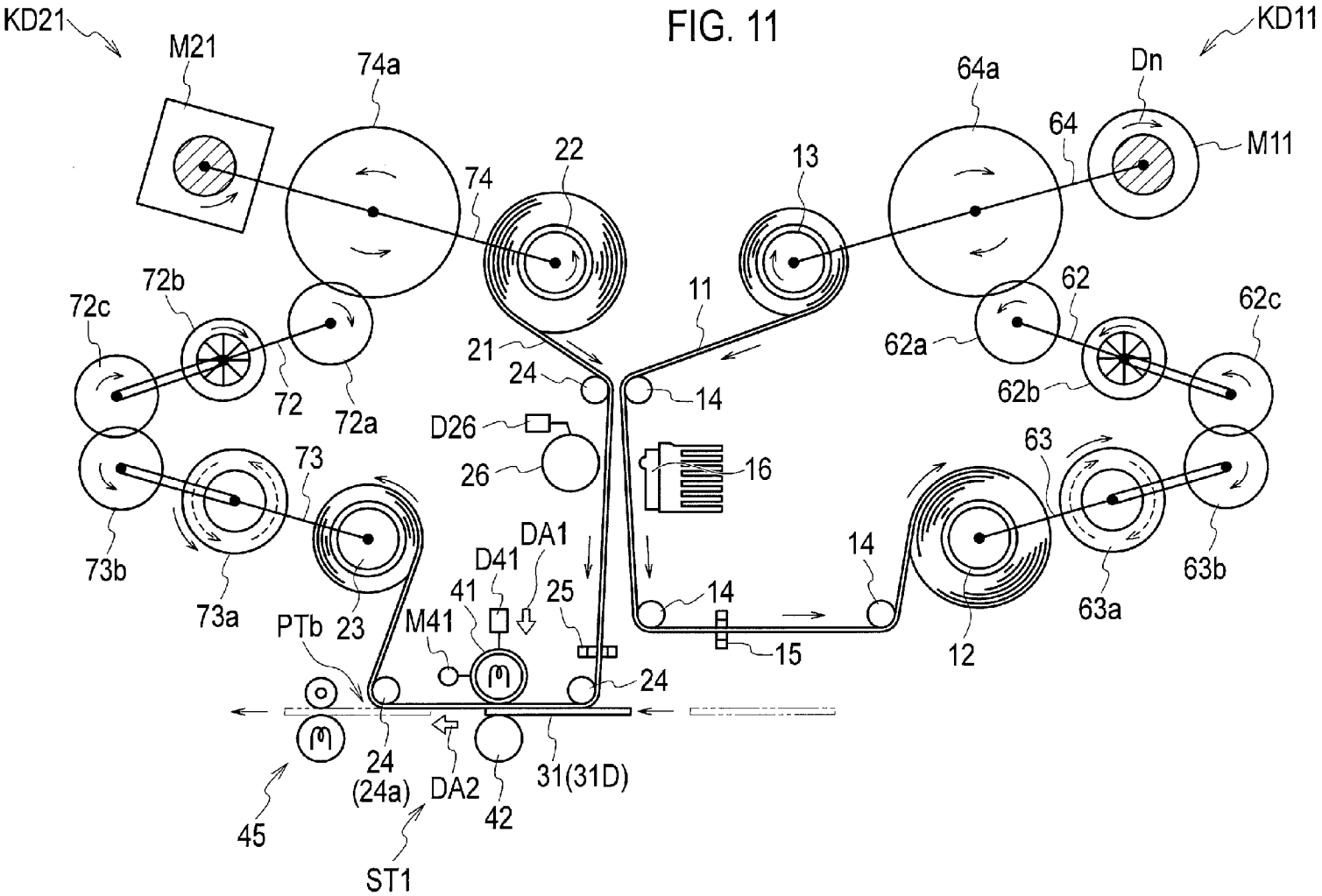
FIG. 11 is a schematic plan view for explaining (C: a re-transfer operation) in the operation of the printing apparatus 51.

On the other hand, for the cueing movement of the card 31, the card 31 is supplied to the re-transfer block ST1 by the transporting rollers 35 (see FIG. 1) from the re-transfer waiting position and cued (FIG. 11: a card 31D).

Then, the control unit CT moves the heat roller 41 toward the opposing roller 42 by driving the heat roller driving unit D41 (an arrow DA1), and makes the heat roller 41 and the opposing roller 42 to hold the transfer film 21 and the card 31 in pressed contact.

Next, the control unit CT rotates the motor M21 and the motor M41 to move the transfer film 21 and the card 31 to the left in FIG. 11 in the thermal pressed contact state (an arrow DA2).

The control unit CT carries out this left movement for the transfer film 21, similarly as in (B: a next color transfer cueing operation). Consequently, a tension is given to the transfer film 21 with a value corresponding to the specified upper limit value of the torque limiter 72*b*.

The transfer film 21 and the card 31 that passed the heat roller 41 will be in a state of being loosely stuck together by the thermal pressed contact, and will move in close contact even after passing the heat roller 41.

Then, the transfer film 21 is acted by the torque limiting function of the torque limiter 72*b* as described above, and wound to the winding bobbin 23 by the torque corresponding to the specified upper limit value, so that the transfer film 21 is pulled by a prescribed force to an upper side in FIG. 11 after passing the guide shaft 24*a*.

Consequently, the card 31 and the transfer film 21 that are continue to be held and moved to the left direction in FIG. 11 by the correcting roller set 45 will be separated well at a position past the guide shaft 24*a* in front of the correcting roller set 45.

After the separation of the transfer film 21, the card 31 is ejected to the stocker 36 and the like.

As such, in the re-transfer operation, a tension is given to the transfer film 21 as the torque limiter 72*b* functions.

In this way, the separation of the transfer film 21 from the card 31 is carried out well smoothly, and a variation of the moving speed caused by the instability of the separation will hardly occur. Consequently, the re-transfer with respect to the card 31 is carried out well.

On the other hand, for the ink film 11, the control unit CT carries out (B: a next color transfer cueing operation), to carry out the cueing of the yellow ink layer Y of the next ink set 11*b*1.

Consequently, in this cueing operation, a tension is given to the ink film 11 as the torque limiter 62*b* functions, so that the cueing operation is carried out without slacking the ink film 11. Therefore, the positioning (the cueing of the yellow ink layer Y at a top of the next ink set 11*b*1) can be made in high precision.

Figure 12:
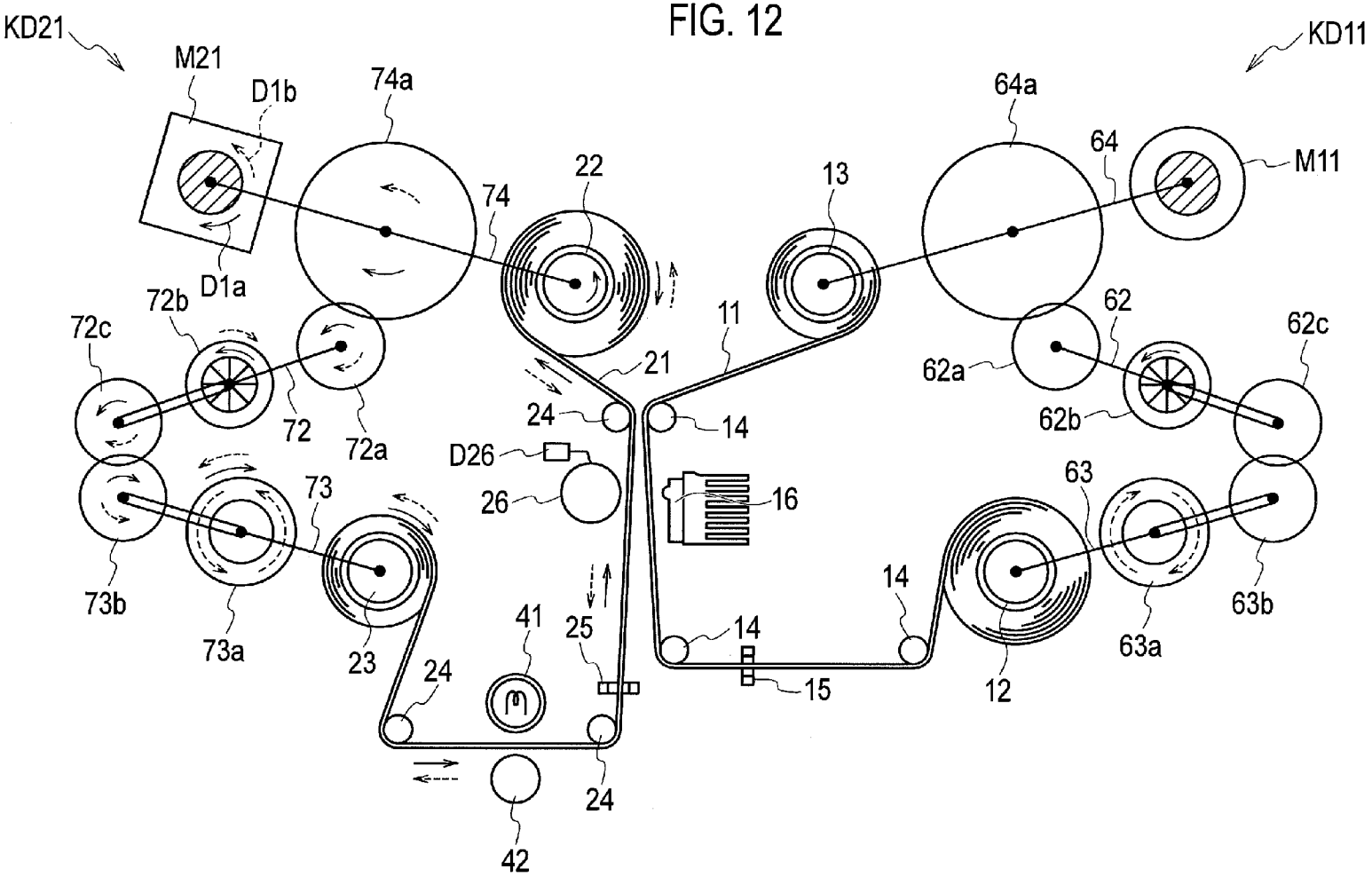
FIG. 12 is a schematic plan view for explaining (D: an unused transfer frame cueing operation) in the operation of the printing apparatus 51.

(D: an Unused Transfer Frame Cueing Operation: see FIG. 12)

After ejecting the re-transferred card 31, the control unit CT carries out the cueing of an unused transfer frame, for a next transfer to the transfer film 21. The already transferred frame that has been re-transferred is positioned at the re-transfer block ST1. Consequently, the transfer film 21 is moved for a prescribed distance such that it is wound to the supply bobbin 22.

For the ink film 11, the cueing of the yellow ink layer Y has been completed in (C: a re-transfer operation). For this reason, the control unit CT maintains a stopping state in which a prescribed tension is given to the ink film 11, without driving the motor M11.

For the transfer film 21, the control unit CT carries out the same operation as in (A: an ink transfer operation), while maintaining the platen roller 26 at the separated position.

Namely, the motor M21 is rotated in the clockwise direction (see an arrow D1*a*), and the transfer film 21 is moved toward the supply bobbin 22 and rewound, without giving any back tension to the transfer film 21.

It is not easy to make the positioning in high precision in the rewinding operation without giving a back tension.

For this reason, the control unit CT carries out the cueing of an unused transfer frame F of the transfer film 21 not only by the rewinding operation to the supply bobbin 22, but also by carrying out an extra rewinding until the cueing position is positioned closer to the supply bobbin 22 side than the thermal head 16 by passing a prescribed position.

After that, the rotational direction of the motor M21 is reversed (see a dashed line arrow D1*b* and other dashed line arrows), and the transfer frame cueing operation as in (B: a next color transfer cueing operation) as described above is carried out, so as to perform the cueing in high precision in a state in which a back tension is given to the transfer film 21.

In this way, the printing apparatus 51 can make the cueing of an unused transfer frame on which the intermediate image is to be transfer printed next, in high precision. As described above, the printing apparatus 51 is made to carry out the moving of the ink film 11 and the moving of the transfer film 21 by a total of two motors, using the motors M11 and M21 that are respectively corresponding to the respective films.

In this way, the printing apparatus 51 requires a low cost, as it suffices to have the number of motors that is small. Also, as the number of motors to be controlled is small, it is possible to realize the control by the control unit with a lower control performance than the conventional one, so that a low cost is achieved in this regard as well.

The printing apparatus 51 is made to carry out the operations of the supply side bobbin and the winding side bobbin that are forming a pair, with a common single motor as a driving source.

In this way, there is no need to match the characteristics of the motors, and it is possible to select the motor without considering a variation due to the change in time of the characteristics of the motor. For this reason, the manufacturing and the maintenance of the printing apparatus 51 become easy.

The printing apparatus 51 carries out the moving of the ink film 11 by the ink film driving unit KD11 including one motor M11, the torque limiter 62*b*, and the one-way clutch 63*a*.

The ink film driving unit KD11 has the transmission route portion DK11 capable of transmitting the torque generated by the motor M11 to the winding bobbin 13 and the supply bobbin 12 respectively, and the transmission route portion DK12 that is branching from the transmission route portion DK11 at the branching portion B11.

The transmission route portion DK11 always transmits the torque generated by the motor M11 to the winding bobbin 13.

The transmission route portion DK12 has the one-way clutch 63*a* arranged in the transmission route, and is made to carry out the transmission and the non-transmission of the torque to the supply bobbin 12 selectively, depending on the rotational direction of the motor M11.

More specifically, the gear ratio at the branching portion B11 (the gear ratio between the driving gear 64*a* and the driven gear 62*a*) is set such that the number of rotations of the supply bobbin 12 by the transmission route portion DK12 is always greater (higher speed) than the number of rotations of the winding bobbin 13 by the transmission route portion DK11, regardless of the amount of windings (the winding outer diameter) of the ink film 11 in the supply bobbin 12.

In this way, in the case where the motor M11 is rotated in the rotational direction corresponding to the moving in the transfer operation of the ink film 11, the clutch 63*a* runs idly and the transmission of the torque is not carried out, whereas in the case where the motor M11 is rotated in the rotational direction corresponding to the moving in the cueing operation, the clutch 63*a* does not run idly and the transmission of the torque is carried out.

For this reason, a back tension is given to the ink film 11 in the cueing operation for the ink layer 11*b* of the ink film 11, so that the cueing can be carried out in high precision, and it becomes possible to move the ink film 11 stably.

Also, a back tension is not given to the ink film 11 in the transfer operation to the transfer film 21, so that a variation in the speed of the ink film 11 is hardly occurring and the uneven transfer that affects the quality will not occur.

The printing apparatus 51 carries out the moving of the transfer film 21 by the transfer film driving unit KD21 including one motor M21, the torque limiter 72*b*, and the one-way clutch 73*a*.

The transfer film driving unit KD21 has the transmission route portion DK21 capable of transmitting the torque generated by the motor M21 to the supply bobbin 22 and the winding bobbin 23 respectively, and the transmission route portion DK22 that is branching from the transmission route portion DK21 at the branching portion B21.

The transmission route portion DK21 always transmits the torque generated by the motor M21 to the supply bobbin 22.

The transmission route portion DK22 has the one-way clutch 73*a* arranged in the transmission route, and is made to carry out the transmission and the non-transmission of the torque to the winding bobbin 23 selectively, depending on the rotational direction of the motor M21.

More specifically, the gear ratio at the branching portion B21 (the gear ratio between the driving gear 74*a* and the driven gear 72*a*) is set such that the number of rotations of the winding bobbin 23 by the transmission route portion DK22 is always greater (higher speed) than the number of rotations of the supply bobbin 22 by the transmission route portion DK21, regardless of the amount of windings (the winding outer diameter) of the transfer film 21 in the winding bobbin 23.

In this way, in the case where the motor M21 is rotated in the rotational direction corresponding to the moving in the transfer operation of the transfer film 21, the clutch 73*a* runs idly and the transmission of the torque is not carried out, whereas in the case where the motor M21 is rotated in the rotational direction corresponding to the moving in the cueing operation, the clutch 73*a* does not run idly and the transmission of the torque is carried out.

For this reason, a back tension is given to the transfer film 21 in the cueing operation for the transfer frame F of the transfer film 21, so that the cueing can be carried out in high precision, and it becomes possible to move the transfer film 21 stably.

Also, a back tension is not given to the transfer film 21 in the ink transfer operation from the ink film 11, so that a variation in the speed of the transfer film 21 is hardly occurring and the uneven transfer that affects the quality will not occur.

The embodiments of the present invention are not limited to the configuration described above, and modifications may be made within a scope that is not digressing from the essence of the present invention.

The printing apparatus 51 has been described in an exemplary configuration having the re-transfer unit 52, but it should not be limited to this example and it may be a configuration not having the re-transfer unit 52.

The operation in that case will include (A: an ink transfer operation), (B: a next color transfer cueing operation) and (D: an unused transfer frame cueing operation), and the effect in each operation can be obtained similarly.

The printing apparatus 51 has been described in a configuration having both the ink film driving unit KD11 and the transfer film driving unit KD21 for driving two bobbins with one motor, but it should not be limited to this case. Namely, the printing apparatus 51 may be in a configuration having at least one of the ink film driving unit KD11 and the transfer film driving unit KD21.

The branching portions B11, B21 are not limited to those configured with the driving gears 64*a*, 74*a* and the driven gears 62*a*, 72*a* respectively, and may be freely configured with arbitrary rotational members.

The types of the motors M11, M21, M26 and M41 are not limited. The step motor, the DC motor, or other motor can be used, and the presence/absence of the deceleration mechanism is also not limited. For example, it may be the motor without the deceleration mechanism as the direct drive type.

The printing apparatus 51 has sensors or encoders (not shown in the figures) for detecting the numbers of rotations of the supply bobbins 12, 22 and the winding bobbins 13, 23, and the detected information is fed back to the control unit CT.

Also, for the other driving portion, a sensor and the like for detecting its moving amount and the like and feeding it back to the control unit CT may be provided according to the need.

In the printing apparatus 51 of the embodiment, the direction of transporting the card 31 in the re-transfer operation has been described with an example of moving from right to left in FIG. 1, but it may be made to carry out the re-transfer while moving the card 31 from left to right.

In that case, the transfer film 21 should be moved in the same direction as in (A: an ink transfer operation). Namely, the transfer film 21 should be moved in backward feeding to rewind to the supply bobbin 22.

Also, the transporting path of the card 31 should be arranged to be left-right reversed with respect to FIG. 1. For example, the correcting roller set 45 is arranged on the right side of FIG. 1 with respect to the heat roller 41.

The re-transfer printing is usually a single transfer operation without involving the superposed transfer.

For this reason, the influence on the formed image due to the variation of the back tension given to the transfer film 21 as described in (A: an ink transfer operation) is significantly less than the case of the superposed transfer, so that it can be substantially ignored in the re-transfer.

Consequently, the sufficiently good re-transfer is possible by the re-transfer operation with the forward feeding to wind the transfer film 21 to the winding bobbin 23 as described in the embodiment, but in the case of dealing with a high level requirement in which it is preferable to suppress the influence due to the variation of the back tension to be less, it is preferable to carry out the re-transfer with the moving in backward feeding to the supply bobbin 22.

Although the present invention has been fully described in connection with the preferred embodiment thereof with reference to the accompanying drawings, it is apparent to those skilled in the art that any changes and modifications are to be understood as included within the scope of the present invention as defined by the appended claims.

The invention claimed is:

1. A printing apparatus for printing images on a transfer film by a transfer operation to transfer ink of an ink film onto the transfer film, comprising:

four bobbins, wherein one film among the ink film and the transfer film is wound around and stretched between a first bobbin and a second bobbin, while another film among the ink film and the transfer film is wound around and stretched between a third bobbin and a fourth bobbin;

a platen roller and a thermal head configured to put the ink film and the transfer film into pressed contact, in the transfer operation; and a driving unit configured to move said one film between the first bobbin and the second bobbin, the driving unit having:

a motor;

a first transmission route portion configured to constantly and directly transmit a torque generated by the motor to the first bobbin, such that the first bobbin is receiving only the torque transmitted from the first transmission route portion; and a second transmission route portion, branching from the first transmission route portion at a branching portion, configured to selectively transmit the torque to the second bobbin, the second transmission route portion being configured to not transmit the torque to the second bobbin when the motor is rotating in a second rotational direction opposite of the first rotational direction.

2. The printing apparatus of claim 1, wherein the motor is rotating in the first rotational direction in the transfer operation, and the motor is rotating in the second rotational direction in a cueing movement of the ink film and the transfer film that is necessary before performing the transfer operation.

3. The printing apparatus of claim 1, wherein the second transmission route portion has a one-way clutch, and the second transmission route portion is configured to selectively carry out a non-transmission and a transmission of the torque by an operation of the one-way clutch.

4. The printing apparatus of claim 1, wherein the second transmission route portion has a torque limiter for regulating an upper limit of the torque to be transmitted to the second bobbin, when the motor is rotating in the second rotational direction, while the first transmission route portion has no torque limiter for regulating the torque to be transmitted to the first bobbin.

5. The printing apparatus of claim 1, wherein the driving unit moves the transfer film, and the printing apparatus further comprises a re-transfer unit for carrying out a re-transfer operation to re-transfer the images that have been printed on the transfer film to an object to be re-transferred.

6. A printing apparatus for printing images on a transfer film by a transfer operation to transfer ink of an ink film onto the transfer film, comprising:

four bobbins, wherein one film among the ink film and the transfer film is wound around and stretched between a first bobbin and a second bobbin, while another film among the ink film and the transfer film is wound around and stretched between a third bobbin and a fourth bobbin;

a platen roller and a thermal head configured to put the ink film and the transfer film into pressed contact, in the transfer operation; and a driving unit configured to move said one film between the first bobbin and the second bobbin, the driving unit having:

a motor;

a first transmission route portion configured to constantly transmit a torque generated by the motor to the first bobbin; and a second transmission route portion, branching from the first transmission route portion at a branching portion, configured to selectively transmit the torque to the second bobbin, the second transmission route portion being configured to not transmit the torque to the second bobbin when the motor is rotating in a first rotational direction, and transmit the torque to the second bobbin when the motor is rotating in a second rotational direction opposite of the first rotational direction, wherein the branching portion is configured to have a driving gear included in the first transmission route portion, and a driven gear included in the second transmission route portion, the driven gear being engaged with the driving gear and having a less number of teeth than a number of teeth in the driving gear.

7. A driving apparatus, comprising:

a driving unit configured to move a medium to be moved between a first bobbin and a second bobbin, the medium to be moved being wound around and stretched between the first bobbin and the second bobbin, the driving unit having:

a motor;

a first transmission route portion configured to constantly transmit a torque generated by the motor to the first bobbin; and a second transmission route portion, branching from the first transmission route portion at a branching portion, configured to selectively transmit the torque to the second bobbin, the second transmission route portion being configured to not transmit the torque to the second bobbin when the motor is rotating in a first rotational direction, and transmit the torque to the second bobbin when the motor is rotating in a second rotational direction opposite of the first rotational direction, wherein the branching portion is configured to have a driving gear included in the first transmission route portion, and a driven gear included in the second transmission route portion, the driven gear being engaged with the driving gear and having a less number of teeth than a number of teeth in the driving gear.

8. The driving apparatus of claim 7, wherein the second transmission route portion has a torque limiter for regulating an upper limit of the torque to be transmitted to the second bobbin, when the motor is rotating in the second rotational direction, while the first transmission route portion has no torque limiter for regulating the torque to be transmitted to the first bobbin.

* * * * *